US005846140A

United States Patent [19]

Hoburg

[11] Patent Number: 5,846,140

[45] Date of Patent: Dec. 8, 1998

[54] GOLF PUTTER

[76] Inventor: Glenn W. Hoburg, 4926 Cypress St., Pittsburgh, Pa. 15224

[21] Appl. No.: 925,562

[22] Filed: Sep. 8, 1997

Related U.S. Application Data

[60] Provisional application No. 60/026,593 Sep. 20, 1996.

[51] Int. Cl.[6] ..... A63B 69/36

[52] U.S. Cl. ..... 473/240; 473/251

[58] Field of Search ..... 473/240, 250, 473/251, 252, 253, 254, 219, 226, 238

[56] References Cited

U.S. PATENT DOCUMENTS

| | | | |
|---|---|---|---|
| 3,019,022 | 1/1962 | Ehmke | 473/240 |
| 3,134,596 | 5/1964 | Boznos | 473/250 |
| 3,403,912 | 10/1968 | Maroun | 473/240 |
| 3,421,765 | 1/1969 | Scott | 473/240 |
| 3,649,028 | 3/1972 | Worrell . | |
| 3,677,553 | 7/1972 | Moore . | |
| 3,820,795 | 6/1974 | Taylor . | |
| 3,953,034 | 4/1976 | Nelson . | |
| 4,108,441 | 8/1978 | Tredway, Sr. . | |
| 4,148,096 | 4/1979 | Haas et al. . | |
| 4,413,824 | 11/1983 | King | 473/240 |
| 4,456,257 | 6/1984 | Perkins . | |
| 4,693,479 | 9/1987 | McGwire . | |
| 4,913,437 | 4/1990 | Newcomb et al. . | |
| 4,953,866 | 9/1990 | Bang | 473/240 |
| 5,000,456 | 3/1991 | Rabold . | |
| 5,288,080 | 2/1994 | Tice . | |
| 5,435,562 | 7/1995 | Stock et al. . | |
| 5,630,764 | 5/1997 | McNair . | |
| 5,640,777 | 6/1997 | Densberger | 473/240 |

*Primary Examiner*—Sebastiano Passaniti
*Attorney, Agent, or Firm*—Webb Ziesenheim Bruening Logsdon Orkin & Hanson, P.C.

[57] ABSTRACT

A golf putter is disclosed for putting a golf ball into the putting cup, wherein the golf putter has a putter shaft, a putter head secured to the putter shaft, a mirror attached on the putter head and a guideline for aligning the putter head to a golf ball. The reflective surface is positioned such that an image of the golf ball is reflected up substantially along the putter shaft for aligning the image with an image of the guideline during at least a part of a swing of the golf putter in order to align the center of the putter head to the center of the golf ball and to align the putter head perpendicularly to the desired ball path.

14 Claims, 2 Drawing Sheets

GOLF PUTTER

RELATED APPLICATION

This application is based upon Provisional patent application Ser. No. 60/026,593, filed Sep. 20, 1996.

BACKGROUND OF THE INVENTION

This invention relates to golf clubs and, more particularly, to golf putters which are used during the golf game for putting the golf ball into the putting cup.

As is known, it is difficult to stroke the ball just right, and one needs a lot of practice to do so. There are several things one has to watch for. One of these things is that the putter head contacts the ball exactly in the middle and that the putter head is exactly perpendicular to the desired path of the golf ball. It is difficult to align the center of both the putter head and the golf ball. This is, among other things, due to the spherical shape of the ball.

There are several devices and golf putters known which attempt to solve the above problem.

One very well-known embodiment which tries to solve the above problem is the golf putter with a guideline on top of the putter head defining the middle of the head. A drawback of this embodiment is that it is still difficult to determine if the center of the putter head is aligned with the center of the ball.

U.S. Pat. No. 5,435,562 discloses a device for aligning a golf club for a stroke through a golf ball. The device comprises a laser beam which transmits, on demand, a laser beam perpendicular to the golf head. It further comprises a target which reflects the laser beam back to the club to confirm if the golf club is correctly aligned for the stroke. A drawback of this invention is that the target has to be placed every time you want to align the club. It is also still possible that the golf ball is not hit by the center of the putter head and, in that case, the club can rotate and will be misaligned before the ball leaves the putter head. Furthermore, the device comprises some electrical components which break down easily when the device is used as a normal golf club.

It is an object of the present invention to provide a device for aligning the head of a golf club to a golf ball and perpendicularly to the desired path of the ball, thereby solving the above-mentioned problems.

SUMMARY OF THE INVENTION

The object is achieved by providing a golf putter comprising a reflective surface attached to the putter head and a guideline for aligning the putter head to the golf ball. The reflective surface being positioned such that an image of the golf ball is reflected up substantially along the putter shaft for aligning the image with an image of the guideline during at least a part of a stroke of the golf putter.

In a first embodiment, a mirror is placed on top of an existing putter head. On the mirror, a guideline is applied which encloses the image of the golf ball when the golf ball is correctly aligned to the putter head and is seen from straight above the putter head. The advantage of this embodiment is that it can easily be determined if the ball is aligned to the putter head, such that the center of the drive surface will hit the center of the ball.

In a second embodiment, a mirror is placed in a recess of the putter head, which is filled with a transparent material. On the mirror, a first guideline for enclosing an image of the golf ball and a third guideline are applied. On top of the putter head, a second guideline is applied for alignment with the third guideline in order to determine the correct view position.

An advantage of this second embodiment is that it can easily be determined if the ball is aligned with the putter head and if the alignment is viewed from the correct position. Another advantage is that the golf putter is solid and, therefore, can be treated as any other golf club.

BRIEF DESCRIPTION OF THE DRAWINGS

Novel features and other objects of the present invention will become apparent from the accompanying drawings and description, in which.

DESCRIPTION OF THE PREFERRED EMBODIMENTS

Figure 1:
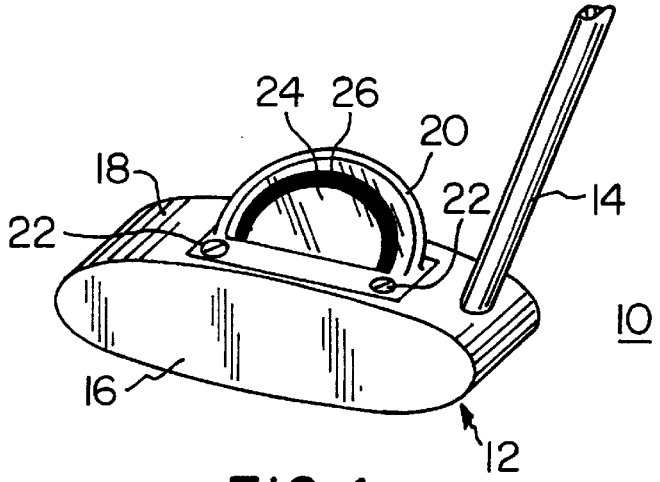
FIG. 1 is a perspective view of a first embodiment according to the invention.

Referring to FIG. 1, a golf putter 10 is shown according to the first embodiment of the invention. The golf putter 10 comprises a putter head 12 and a putter shaft 14 attached thereto. The putter head has at least a drive surface 16 for stroking a golf ball, and an upper surface 18. On the upper surface 18, a back plate 20 extending from the upper surface preferably under an angle of approximately 45°, is secured with, for example, two screws 22. A mirror 24 is adhered to the back plate 20 with, for example, glue or adhesive tape.

The mirror 24 with the guideline 26 faces generally in the same direction as the drive surface 16 and is so arranged that when the image of the guideline 26 encloses the image of a golf ball, the center of the putter head 12 is aligned with the center of a golf ball.

The golf putter 10 can be a specially made putter or an on-the-market available putter, thereby allowing use of the invention with an already purchased golf club.

For stroking the golf ball correctly, one has to place the putter 10 generally behind the golf ball and look from above in the mirror 24. Then, one has to align the image of the golf ball with the image of the guideline such that the semi-circular guideline 26 encloses the image of the ball. The putter head 12 is now correctly aligned to the golf ball.

Figure 2:
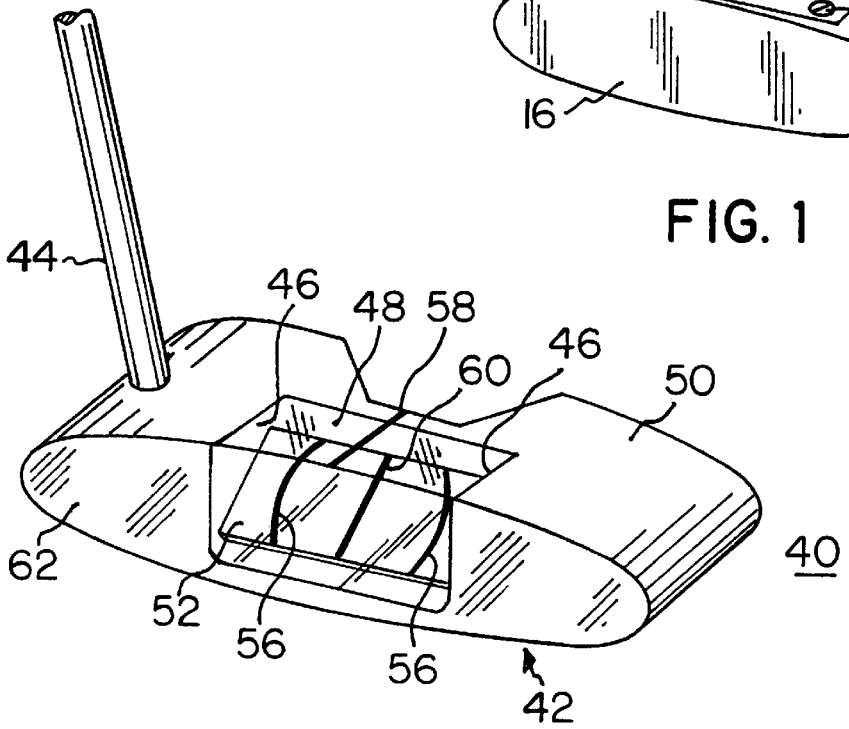
FIG. 2 is a perspective view of a second embodiment according to the invention.

FIG. 2 shows a golf putter 40 according to the second embodiment of the invention. The golf putter 40 consists of a putter head 42 and a putter shaft 44 attached thereto.

Figure 3:
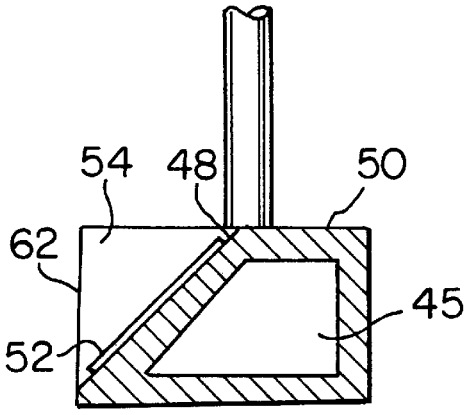
FIG. 3 is a lateral sectional view of the embodiment of FIG. 2.

The putter head 42 comprises a cast lead weight 45, molded in said, for example, fiberglass putter head, a recess formed by two side walls 46 and a back wall 48, which is inclined under an angle of preferably 45° with regard to the upper surface 50 of the putter head. (See also FIG. 3.) On the back wall 48, a mirror 52 is attached. The recess is filled with a transparent material 54, such as, for example, urethane, such that the upper surface of the transparent material 54 lies in the upper surface 50 of the putter head and that the recess is filled such that one flat drive surface 62 is formed.

On the mirror 52, a first guideline 56, consisting of two arcs, and a third guideline 60 are applied. Furthermore, a second guideline 58 is applied to the upper surface 50 of the putter head 42.

The three guidelines (56, 58, 60) can be applied on any of the upper surface of the transparent material, the drive surface of the transparent material, the mirror or in the transparent material, as long as the second 58 and the third 60 guidelines are not applied on the same surface.

Figure 4:
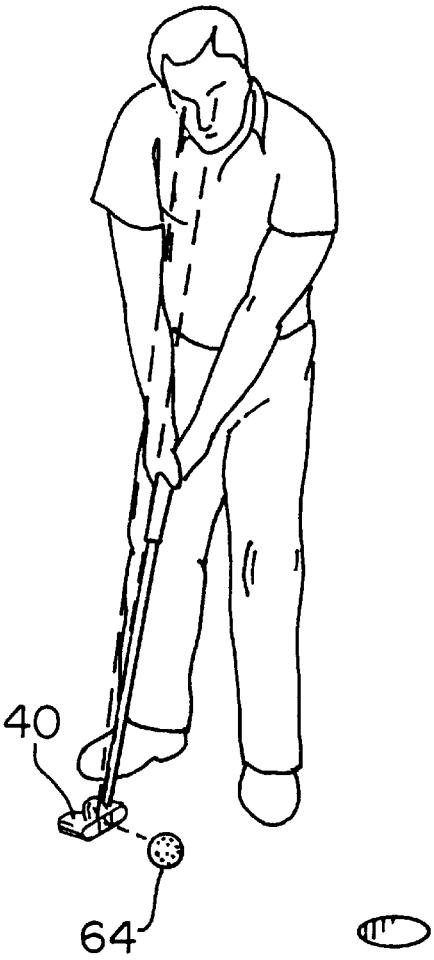
FIG. 4 shows the use of the second embodiment.
Figure 5:
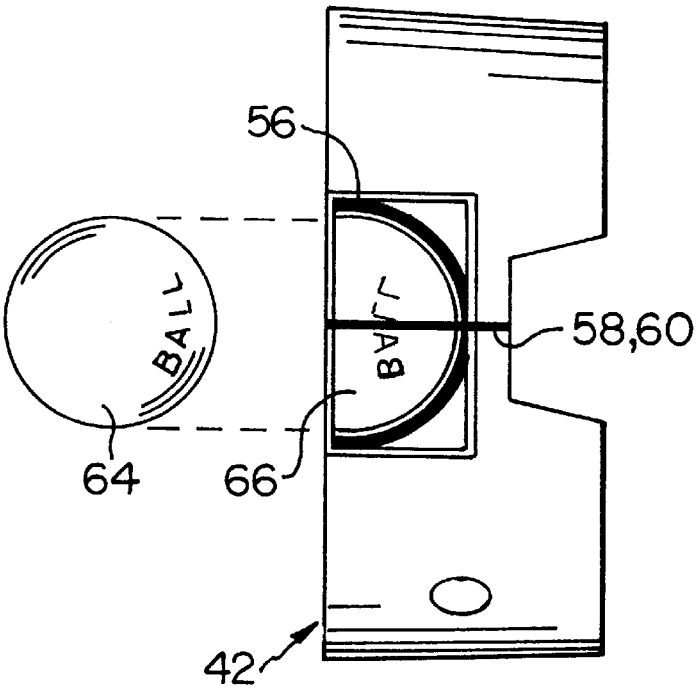
FIG. 5 shows the alignment of the image of the golf ball and the images of the guidelines seen from the correct view position.

For correctly using the putter 40 according to the invention, one has to place the putter 40 generally behind the golf ball 64 (see FIG. 4) and look from above into the mirror 52 of the putter. One looks from the right point of view into the mirror when the second and third guidelines 58, 60 are seen as one guideline (see FIG. 5). Seen from this viewpoint, the putter head 42 must be adjusted so that the image of the first guideline 56 encloses the image 66 of the golf ball 64. When adjusted properly, the putter head 42 is aligned to the golf ball 64, such that the center of the putter head 42 will hit the center of the golf ball 64.

The shape of the first guideline 26, 56 is dependent on the angle of the surface on which it is applied relative to the view direction. A semi-circular guideline, as seen, may actually be a semi-elliptical guideline.

Another embodiment of the first guideline consists of two straight lines, which border the image of the golf ball.

The guidelines can be of any shape as long as one guideline aligns with the image of the golf ball and the other guidelines enable it to be determined that the alignment is viewed from the correct position.

Although specific embodiments of the invention have been disclosed, it will be understood by those skilled in the art that the foregoing and other changes can be made to the specific embodiments without departing from the spirit and the scope of the invention.

I claim:

1. A golf putter comprising:

a putter shaft, a putter head secured to said putter shaft, a reflective surface attached on said putter head, and a guideline for aligning said putter head to a golf ball, said guideline forming at least a part of an arc for centering said image of said golf ball in said guideline image, said reflective surface being positioned such that an image of said golf ball is reflected up substantially along said putter shaft for aligning said image with an image of said guideline during at least a part of a swing of said golf putter.

2. The golf putter according to claim 1, wherein said guideline is at least a part of an ellipse for centering said image of said golf ball in said guideline image.

3. The golf putter according to claim 1, wherein said guideline is positioned on said reflective surface.

4. The golf putter according to claim 1, wherein said reflective surface is the reflective surface of a mirror.

5. The golf putter according to claim 1, wherein said guideline forms a semicircle for centering said image of said golf ball in said guideline image.

6. A golf putter comprising:

a putter shaft, a putter head secured to said putter shaft, said putter head having a recess, a reflective surface secured in said recess, and a first guideline for aligning said putter head to a golf ball, said first guideline forming at least part of an arc for centering said image of said golf ball in said first guideline image, said reflective surface being positioned such that an image of said golf ball is reflected up substantially along said putter shaft for aligning said image with an image of said first guideline during at least a part of a swing of said golf putter, wherein said recess is at least partially filled with a transparent material.

7. The golf putter according to claim 6, wherein said first guideline is at least a part of an ellipse for centering said image of said golf ball in said first guideline image.

8. The golf putter according to claim 6, comprising at least a second and a third guideline for aligning said second guideline with said third guideline to determine the correct viewpoint.

9. The golf putter according to claim 8, wherein said third guideline is identical to said first guideline.

10. The golf putter according to claim 8, wherein said guidelines are positioned on at least one of said reflective surface and the outer surfaces of said transparent material, said second and third guidelines being positioned on different surfaces.

11. The golf putter according to claim 6, wherein said first guideline is positioned on said reflective surface.

12. The golf putter according to claim 6, wherein said reflective surface is the reflective surface of a mirror.

13. The golf putter according to claim 6, wherein said guideline is at least a part of an ellipse for centering said image of said golf ball in said guideline image.

14. The golf putter according to claim 6, wherein said guideline forms a semicircle for centering said image of said golf ball in said guideline image.

* * * * *